US006543654B1

(12) United States Patent
Uhl et al.

(10) Patent No.: US 6,543,654 B1
(45) Date of Patent: Apr. 8, 2003

(54) DEVICE FOR EMPTYING CONTAINERS FILLED WITH LIQUIDS

(75) Inventors: Stephan Uhl, Haan (DE); Wolfgang Huber, Fridolfing (DE); Frank Rainer Schuster, Erkrath (DE)

(73) Assignee: Ecolab GmbH & Co. OhG, Dusseldorf (DE)

( * ) Notice: Subject to any disclaimer, the term of this patent is extended or adjusted under 35 U.S.C. 154(b) by 0 days.

(21) Appl. No.: 09/763,383

(22) PCT Filed: Aug. 17, 1999

(86) PCT No.: PCT/EP99/06007

§ 371 (c)(1),
(2), (4) Date: Feb. 21, 2001

(87) PCT Pub. No.: WO00/12403

PCT Pub. Date: Mar. 9, 2000

(30) Foreign Application Priority Data

Aug. 26, 1998 (DE) ..... 198 38 685

(51) Int. Cl.[7] ..... B67D 5/60

(52) U.S. Cl. ..... 222/464.1; 222/541.1; 222/541.6; 222/153.06; 220/276; 215/253

(58) Field of Search ..... 222/383.1, 383.3, 222/382, 464.1, 464.3, 541.1, 541.6, 153.06, 83, 91, 541.2; 220/255, 256.1, 258.2, 266, 276, 277, 367.1, DIG. 9; 215/250, 253, 307; 141/383, 384

(56) References Cited

U.S. PATENT DOCUMENTS 3,613,955 A * 10/1971 Richard ..... 222/83
3,840,136 A * 10/1974 Lanfranconi et al. ..... 215/6
3,912,115 A * 10/1975 Smith ..... 220/277
4,132,308 A * 1/1979 Goncalves ..... 206/219
4,386,637 A 6/1983 Buchanan et al.
4,548,344 A * 10/1985 Hestehave et al. ..... 222/464
4,615,437 A * 10/1986 Finke et al. ..... 206/222
4,640,446 A * 2/1987 Walker ..... 222/416
4,741,437 A * 5/1988 Gorski et al. ..... 206/222
4,832,230 A * 5/1989 Janowitz ..... 222/80
4,832,237 A * 5/1989 Hurford, Jr. ..... 222/464
5,181,626 A * 1/1993 Daenen et al. ..... 220/282
5,402,909 A 4/1995 Cramer et al.
5,799,813 A * 9/1998 Letica ..... 220/254
5,811,060 A * 9/1998 Laguna ..... 422/102
5,842,593 A * 12/1998 von Holdt ..... 220/212.5
5,887,766 A * 3/1999 Yang ..... 222/466
5,890,517 A * 4/1999 Laible ..... 137/614.04
5,944,229 A * 8/1999 Rokkjaer ..... 222/153.07
6,006,961 A * 12/1999 Wark ..... 222/527
6,045,012 A * 4/2000 Hansen ..... 222/464.1

FOREIGN PATENT DOCUMENTS

DE 2620471 A 11/1977

* cited by examiner

*Primary Examiner*—Gene Mancene
*Assistant Examiner*—F. Nicolas
(74) *Attorney, Agent, or Firm*—Merchant & Gould P.C.

(57) ABSTRACT

The invention relates to a device for emptying containers (2) filled with liquids, especially canisters and barrels, with an adapter (5)that can be fixed in a bung hole (3) of the container (2). The adapter (5) is fitted with a suction lance (7) pointing towards the container and has a degassing device. The device has a coupling piece (6) that can be attached to the adapter (5) for connecting a suction device (9). The adapter (5) has a set breaking point (10) surrounding the connection of the suction lance (7) by means of which the suction lance (7) can be pushed into the interior of the container. In a special embodiment, the set breaking point (10) is configured as a series of holes surrounding the central part **(5*b*) connected to the suction lance (7)**.

8 Claims, 2 Drawing Sheets

DEVICE FOR EMPTYING CONTAINERS FILLED WITH LIQUIDS

The invention relates to a device for emptying containers filled with liquids, especially canisters and barrels, comprising an adapter, which is fixable in a bung opening of the container and provided with a suction lance pointing into the container and which has a degassing device, and a coupling member connectible to the adapter for connection of a suction device.

Devices of that kind for emptying barrels and canisters filled with liquids are known in practice in various forms. In these known devices the adapters provided with the suction lances are firmly pressed or knocked into the bung openings of the containers. As the containers cannot be emptied by way of the suction lances so as to be free of residue, a residual quantity of liquid always remains in the containers.

In order to be able to manacle appropriate disposal of containers filled with, for example, chemicals or dangerous substances, it is for this reason necessary after emptying the container to remove the suction lance from the bung opening, together with any parts of the suction device that may be connectible thereto, with the assistance of tools. Since the adapters are knocked into the bung openings to be fluid-tight or liquid-tight, the removal of the adapters is very time-consuming and thus a costly operation. Moreover, an unintended contact of the product with the contaminated suction lance during removal of the adapter can almost never be excluded.

On that basis the invention is directed to the technical problem of constructing a device for emptying liquid-filled containers of the kind stated above in such a manner that this device is constructed in simple manner and enables complete emptying of the container without risk of the user coming into contact with the contaminated suction lance.

In accordance with the invention the solution of this problem is characterised in that the adapter has a frangible location which surrounds the connection of the suction lance and by way of which the suction lance can be pushed into the interior of the container.

Through the construction of the frangible location in the region of the connection of the suction lance with the adapter it is possible in the case of a device constructed in accordance with the invention to push the suction lance into the interior of the container after emptying of the container by way of the lance, thereby to be able to empty the liquid residue from the container by way of the re-opened bung opening. Since removal of the suction lance from the container is not necessary, the risk of the user of this device coming into contact with the liquid disposed in the container is thus minimised by this design.

According to a special embodiment of the invention the frangible location is formed as a series of holes coaxially surrounding the connection of the suction lance. This form of the frangible location on the one hand is very simple to produce in terms of production technology and on the other hand enables easy release of the frangible location on pressing of the suction lance into the container.

According to a preferred embodiment of the invention the frangible location is at the same time constructed as a degassing device. These degassing devices serve the purpose on the one hand of allowing escape from the container of gases emanating from the liquid and on the other hand of allowing a corresponding volume of air to flow in during sucking away of the liquid by way of the suction device connected to the suction lance and thus of avoiding the creation of a vacuum in the container interior. In the case of the device according to the invention this degassification or gas issue can take place directly by way of the frangible location surrounding the connecting point of the suction lance and formed by perforations.

Further features and advantages of the invention are evident from the following description of the accompanying drawing, in which an embodiment of the device according to the invention is schematically illustrated by way of example. In the drawings.

Figure 1:
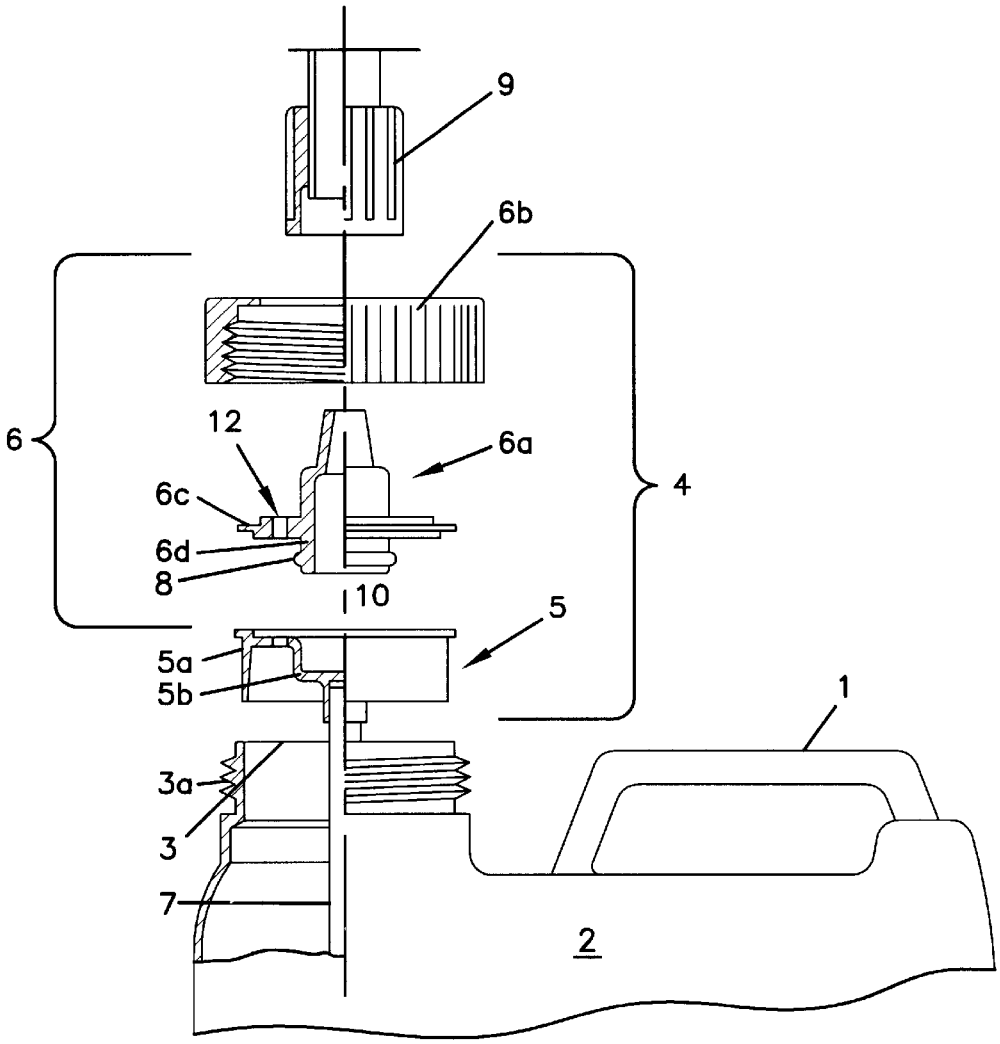
FIG. 1 is an exploded drawing of a removing device fixable to a canister.

The illustration in FIG. 1 shows a canister 2, which is provided with a handle 1, for the storage of liquids. The canister 2 can be filled with liquid by way of a bung opening 3.

For emptying the canister 2, an emptying device 4 explained in more detail in the following is inserted into the bung opening 3. This emptying device 4 substantially consists of an adapter 5 which can be knocked into the bung opening 3 to be fluid-tight and a coupling member 6, which is connectible to the adapter 5, for attachment of a suction device. The suction connector 9 can be placed on the part of a connecting member 6*a* protruding out of an opening in the box nut 6*b* of the coupling member 6.

As can be seen from the structure of the emptying device 4 illustrated in exploded manner in FIG. 1, the adapter 5 to be inserted into the bung opening 3 has, near the edge 5*a* to be inserted into the bung opening 3, a pot-shaped center part 5*b*, the deepest point of which is directed into the interior of the canister 2. A suction lance 7 is connected with the adapter 5 at this deepest point of the center part 5*b* of the adapter 5 and, pointing into the interior of the canister 2, serves for emptying the canister 2. Whereas for transport the canister 2 can be closed, also with the adapter 5 inserted into the bung opening 3, by way of a non-illustrated closure cap able to be tightly screwed onto an external thread 3*a* of the bung opening 3, for emptying of the canister 2 the adapter 5 can be connected with a coupling member 6. This member consists of a connecting member 6*a* and a box nut 6*b* which can be screwed onto the external thread 3*a* of the bung opening 3.

To enable a fluid-tight connection of the connecting member 6*a* to the adapter 5, the connecting member 6*a* has an O-ring 8 on the outer circumference of the region, which is to be inserted into the centre part 5*b* of the adapter 5, of the insert member 6*d*. The connecting member 6*a* comprises an encircling flange 6*c* which bears on the edge 5*a* of the adapter 5 and which has a degassing bore 12. The large circumference of the flange 6*c* prevents the connecting member 6*a* from passing into the bung opening 3 of the canister 2. The degassing bore 12 enables gas issue and degassing of the canister 2 even when the coupling member 6 is firmly screwed on.

Due to the box nut 6*b*, which bears on the encircling flange 6*c*, the connecting member 6*a* of the coupling member 6 is sealingly clamped to the adapter 5 when firmly screwed onto the external thread 3*a* of the bung opening 3.

The free end, which points away from the canister 2, of the connecting member 6*a* of the coupling member 6 is constructed so that a suction device 9, for example a cleaning pump, is connectible thereto.

Figure 2:
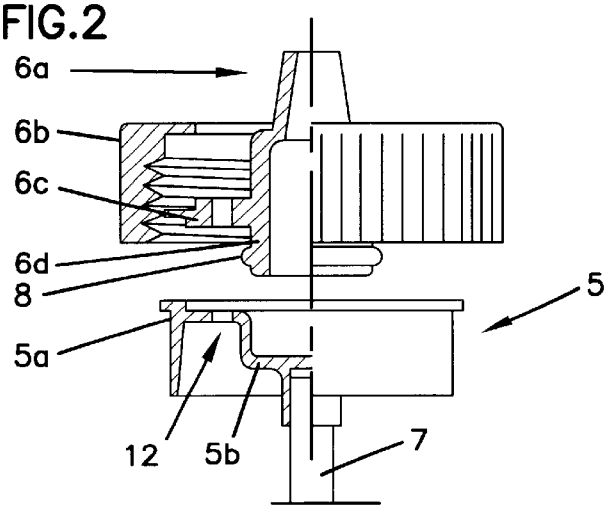
FIG. 2 is an exploded illustration of a conventional emptying device.

An emptying device 4 corresponding to the prior art is illustrated in FIG. 2. If the container, which is not illustrated, has to be cleaned after emptying and for that purpose the bung opening thereof has to be completely exposed, it is very awkward to take the parts of the emptying device 4 out of the bung opening 3. This is due in the first instance to the fact that the edge 5*a* of the quite rigid adapter 5 is knocked into the bung opening 3 to be fluid-tight. Removal is hardly possible without destroying the bung opening and in any event only with very special tools.

Figure 3:
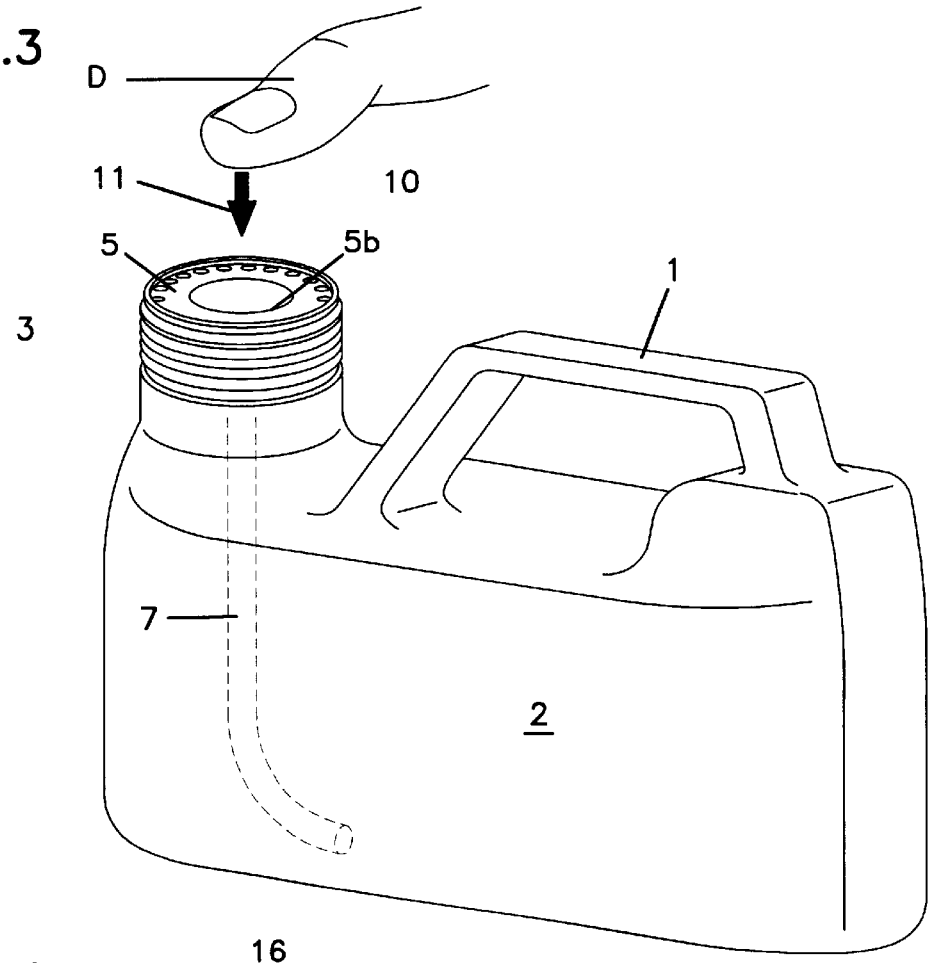
FIG. 3 is a schematic perspective view of an adapter constructed in accordance with the invention.

This situation is solved in a quite different way with the proposed suction lance 7 able to be knocked in. As evident from FIG. 3, a frangible location 10 is formed coaxially around the attachment of the suction lance 7 to the centre part 5*b* of the adapter 5. In the illustrated embodiment the intentional weakening of the material is achieved by a perforation along the line of intended breakage. This can, however, also be carried out by weakening without destruction or by incisions formed at a spacing from one another. As indicated in FIG. 3 by the arrow 11, the centre part 5*b*, which is provided with the suction lance 7, of the adapter 5 can be pressed into the canister 2 by, for example, an object or thumb D. On application of pressure to the centre part 5b, the perforation tears along the frangible location 10 and the bung opening 3 is exposed in almost full cross-section, so that after the pressing in of the centre part 5*b* of the adapter 5 the canister 2 can be completely emptied and subsequently disposed of in appropriate manner.

In addition to formation of the frangible location 10, the illustrated perforation additionally fulfils the function of a degassing device, as gases emanating from the liquid can escape from the canister 2 through the holes or small openings formed along the line of intended breakage and the formation of a vacuum in the canister 2 during sucking away of the liquid by way of the suction lance 7 is prevented in the manner that a volume of air corresponding to the withdrawn quantity can flow in.

The embodiment depicted in FIG. 3 has a circular opening of the pot-shaped centre part 5*b* concentrically in the adapter 5. The lower cylindrical region of the connecting member 6*a*, i.e. the insert member 6*b*, is inserted into this opening, wherein the O-ring 8 arranged in the outer circumference of the insert member 6*d* sealingly bears against the inner circumference of the pot-shaped centre part 5*b*. The cross-sectional shape, here circular, of the system consisting of pot-shaped centre part 5*b* and insert member 6*d* of the connecting member 6*a* can, in an advantageous embodiment, also be constructed as an access security device. For example, it is possible to associate specific geometric cross-sectional shapes with specific products. Thus, for example, a circular cross-section can be selected for product A, a rectangular cross-section for product B, a square cross-section for product C and so forth, so that it is disclosed to the user by the cross-sectional shape of the pot-shaped centre part 5*b* which liquid is disposed in the canister 2. Moreover, this construction of the system of centre part 5*b* and insert member 6*d* is suitable as a so-termed 'lock-out' precautionary measure, by which the use of system parts supplied therewith for the use of products of other manufacturers can be prevented or, at least, made very difficult.

Figure 4:
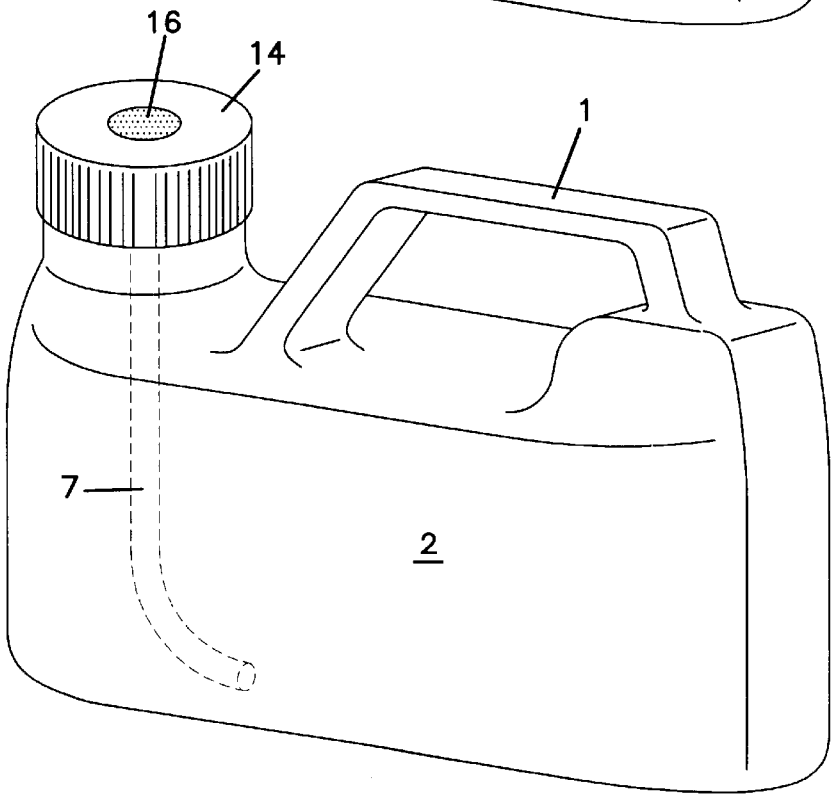
FIG. 4 is a view similar to FIG. 3, but closed for transport.

In FIG. 4 there is illustrated the cask according to FIG. 3 made ready for transport through closure by means of an appropriate cover cap 14. This cap 14 is advantageously constructed as a so-termed degassification cap, i.e. it has in the cover an opening which is sealed off in a liquid-tight, but degassification-active, manner by a pad 16 inserted in the cap. The internal thread of the cover cap 14 obviously corresponds with that of the box nut 6*b* and matches the external thread 3*a* of the bung opening 3.

An emptying device 4 constructed in such a manner thus represents a possibility, which is simple to manage, for completely emptying the canister 2 without the adapter 5, which is knocked into the bung opening 3, having to be removed for that purpose from the bung opening 3 with the aid of tools. Through the mere pushing of the centre part 5*b* of the adapter 5 into the interior of the canister 2, the risk of a user coming into contact with the liquid is also minimised.

LIST OF REFERENCE NUMERALS

1 handle
2 canister
3 bung opening
3*a* external thread
4 emptying device
5 adapter
6 coupling member
6*a* connecting member
6*b* box nut
6*c* flange
6*d* insert member
8 O-ring
9 suction connection
10 frangible location
11 arrow
12 degassing opening
D thumb

What is claimed is:

1. A device for emptying containers filled with liquids and having a bung opening, the device comprising:

an adapter comprising an edge, a center part, and a frangible location between the edge and the center part, the edge being constructed for placement within the bung opening;

a suction lance attached to the center part of the adapter and extending from the adapter so that when the adapter is placed within the bung opening, the suction lance extends into the container;

a coupling member connectable to the adapter for connecting a suction device to the adapter; and a cover cap wherein the cover cap includes a pad constructed to provide degassification.

2. A device according to claim 1, wherein the frangible location comprises a series of holes surrounding the center part.

3. A device according to claim 2, wherein the coupling member comprises a flange and a connecting member, the flange being constructed to rest on the edge of the adapter and cover the frangible location.

4. A device according to claim 3, wherein the flange includes a degasification bore.

5. A device according to claim 1, wherein the coupling member comprises an insert member that fits within the center part of the adapter.

6. A device according to claim 5, wherein the insert member has a shape that corresponds to the center part so that the insert member fits within the center part.

7. A device according to claim 5, further comprising an O-ring between the insert member and the center part of the adapter.

8. A device according to claim 1, wherein the frangible location can be broken by pushing on the center part of the adapter.

* * * * *